US007731008B2

(12) United States Patent
Peart et al.

(10) Patent No.: US 7,731,008 B2
(45) Date of Patent: Jun. 8, 2010

(54) GLOBAL TILL

(75) Inventors: Roger Peart, Hickory Hills, IL (US); Paul E. Specht, Glenview, IL (US)

(73) Assignee: Block and Company, Inc., Wheeling, IL (US)

( * ) Notice: Subject to any disclaimer, the term of this patent is extended or adjusted under 35 U.S.C. 154(b) by 0 days.

(21) Appl. No.: 12/193,452

(22) Filed: Aug. 18, 2008

(65) Prior Publication Data

US 2009/0045030 A1 Feb. 19, 2009

Related U.S. Application Data

(60) Provisional application No. 60/956,359, filed on Aug. 16, 2007.

(51) Int. Cl.
*A45C 1/12* (2006.01)

(52) U.S. Cl. ..... 194/350; 232/1 D; 206/0.84

(58) Field of Classification Search ..... 206/0.84; 232/1 D

See application file for complete search history.

(56) References Cited

U.S. PATENT DOCUMENTS 2,973,766 A * 3/1961 Milbourne ..... 131/235.1
4,314,632 A 2/1982 Hutchinson
4,638,908 A * 1/1987 Baitz et al. ..... 206/0.8
5,502,294 A 3/1996 Yang
5,520,286 A * 5/1996 Murakoshi et al. ..... 206/561
5,536,922 A * 7/1996 Cheng ..... 235/7 R
5,664,856 A * 9/1997 Pacetti ..... 312/348.3
5,756,977 A 5/1998 Biss
5,829,673 A * 11/1998 Harr, Jr. ..... 232/15
6,105,858 A * 8/2000 Chien ..... 232/1 D
2001/0032790 A1 * 10/2001 Carter ..... 206/0.81
2003/0184199 A1 * 10/2003 Jananji ..... 312/348.3
2007/0062839 A1 * 3/2007 Patterson ..... 206/523

* cited by examiner

*Primary Examiner*—Patrick Mackey
*Assistant Examiner*—Mark Beauchaine
(74) *Attorney, Agent, or Firm*—Cook Alex Ltd.

(57) ABSTRACT

A cash drawer insert is disclosed which includes a paper currency receiving and storage area and a coin receiving and storage area, each of which can be selectively reconfigured to accommodate paper currencies and coins of a wide variety of sizes, shapes, dimension and denominations. Each of these areas is provided with opposed ribbed walls that are adapted to removably receive the ends of divider partitions having locking tabs and locking toggles that secure to such dividers at any desired transverse location. Bill weights having mounting flanges with locking tabs for selective placement along a rearwall of the till as well as a pivotable auxiliary paper currency tray that permits storage of two different paper currencies in a single paper currency compartment are also disclosed.

11 Claims, 9 Drawing Sheets

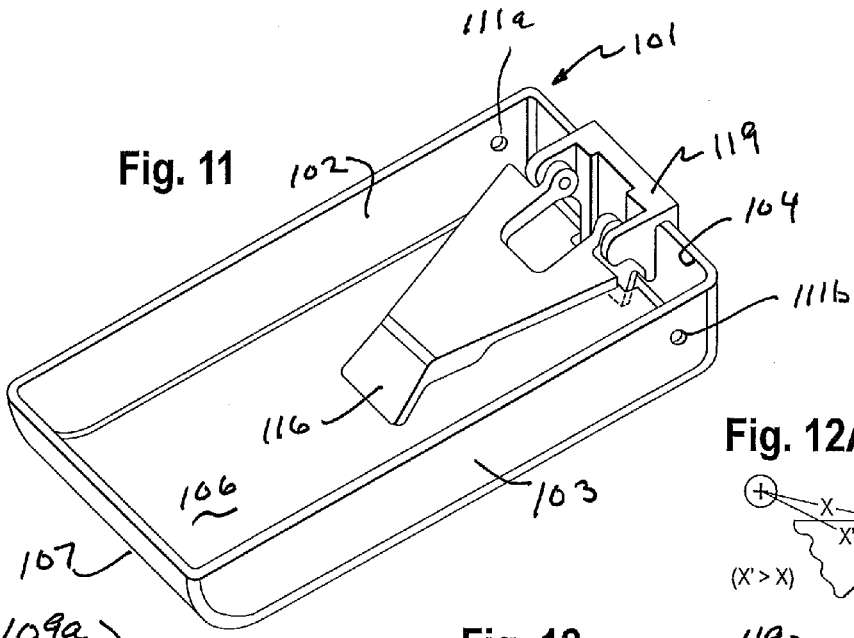
Fig. 11
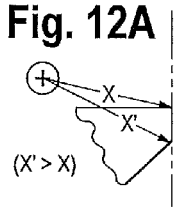
Fig. 12A
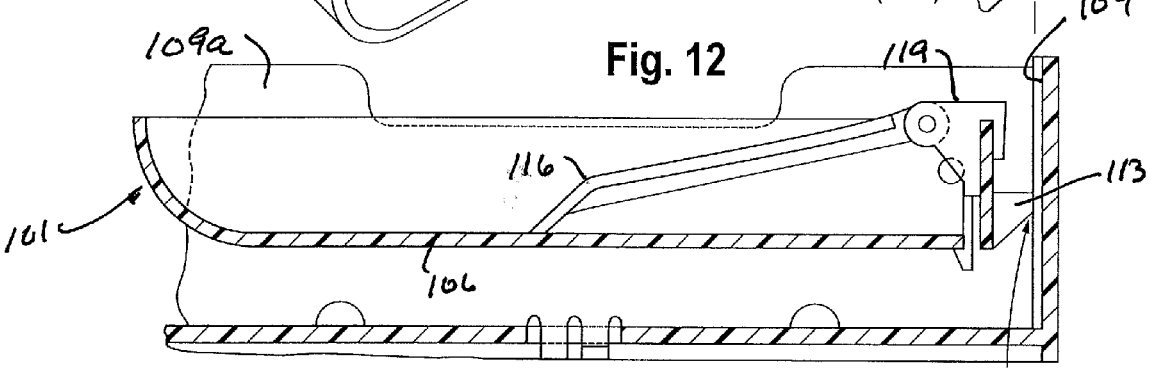
Fig. 12
Fig. 12A
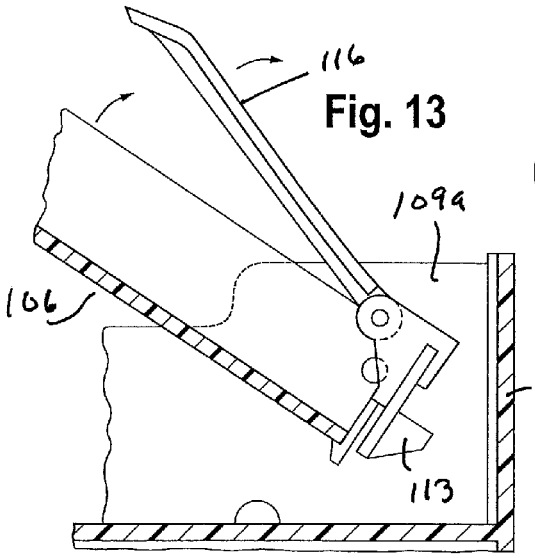
Fig. 13
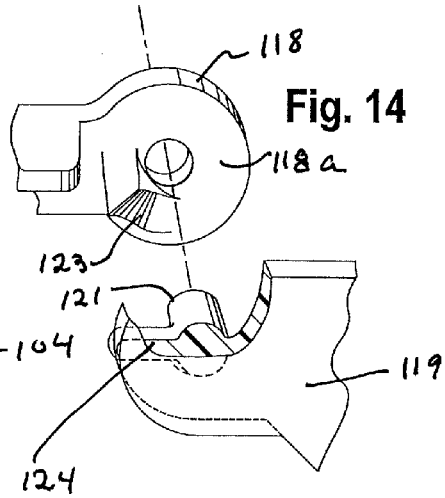
Fig. 14

GLOBAL TILL

CROSS REFERENCE TO RELATED APPLICATION

This application claims the benefit of the filing date of U.S. Provisional Application Ser. No. 60/956,359, filed Aug. 16, 2007, the entire contents of which are herein incorporated by a reference.

BACKGROUND

The present disclosure relates to inserts for cash drawers or tills and, more particularly, to cash drawer inserts or tills which can be selectively configured and reconfigured to accommodate paper currency and bank notes as well as coins and other media having a variety of denominations, sizes, shapes and dimensions.

Countries throughout the world use paper currency and coins that vary in size and shape with respect to each other and, depending upon the country involved, upon the denomination of such paper currency and coins. While the United States and Canada currently utilize a standard length and width for their respective denominations of paper currency, elsewhere dimensional differences are used to distinguish the various denominations. For example, Euro notes can range from 120 to 153 mm in length and 62 to 82 mm in width, Japanese Yen notes vary from 150 to 160 mm in length while maintaining a standard width of 76 mm and British Pound notes range from 135 to 156 mm in length and 75 to 85 mm in width. Correspondingly, all of these countries have coins which vary in thickness and diameter for each denomination.

These differences between world paper currencies and coins require that cash drawers or inserts and tills used at points of sale and elsewhere have specialized configurations uniquely associated with the country or location in which they are used.

Heretofore, cash box inserts or tills often have had fixed paper currency and coin receiving compartments or a limited ability to reconfigure the same to accommodate the different world-wide requirements for efficient handling of paper currency, coins and other media which are to be stored therein and dispensed therefrom.

SUMMARY OF THE INVENTION

The disclosed till incorporates repositionable dividers or partitions which can be selectively configured and reconfigured to accommodate and provide uniform or non-uniform paper currency receiving and storage areas that are associated with selectively positionable bill weights alone or with shelf-type Euro style paper currency receiving and storage units. If desired, the paper currency receiving and storage areas can be configured to include only such shelf-type Euro style paper receiving and storage units.

The disclosed tills also include coin receiving and storage areas which can be used with dividers or partitions that can be selectively positioned in the till itself or in a removable coin tray contained in the till to provide the desired coin compartment configuration.

An additional feature of the disclosed tills is the use of an auxiliary tray which can be pivotally mounted in a given paper currency compartment to provide that given paper currency compartment with a capability of separately storing and providing access to two different paper currencies in that same compartment.

Reference is now made to the accompanying detailed description of a preferred and other embodiments of the present invention as shown in the accompanying drawings wherein like reference numbers indicate corresponding parts throughout.

BRIEF DESCRIPTION OF THE DRAWINGS

FIG. 1 is a top perspective view of a first embodiment of a till embodying aspects of the present invention prior to the installation of any partitions, coin trays, bill weights or the like;

FIG. 11 is a top perspective view of an auxiliary currency tray for use with a till embodying aspects of the present invention;

FIG. 12 is a side sectional view of the auxiliary paper currency tray shown in FIG. 11 as mounted in a partially shown sectional view of the till;

FIG. 12A is a fragmentary view of the back side of the auxiliary currency tray shown in FIG. 12 illustrating a buttress for maintaining the auxiliary paper currency tray in a horizontal position when the tray is fully lowered;

FIG. 13 is a partial sectional view of the auxiliary currency tray shown in FIG. 12 in an inclined position;

FIG. 14 is an exploded fragmentary view of the hinge mechanism associated with the bill weight of the auxiliary paper currency tray;

DETAILED DESCRIPTION

Figure 1:
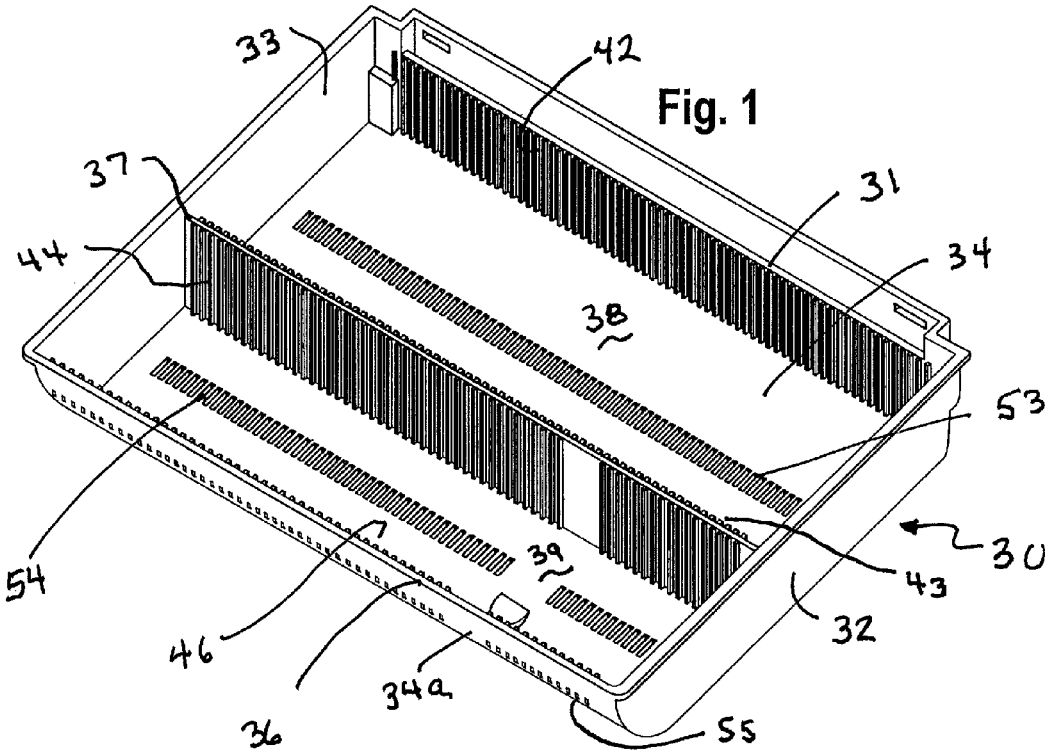
Figure 2:
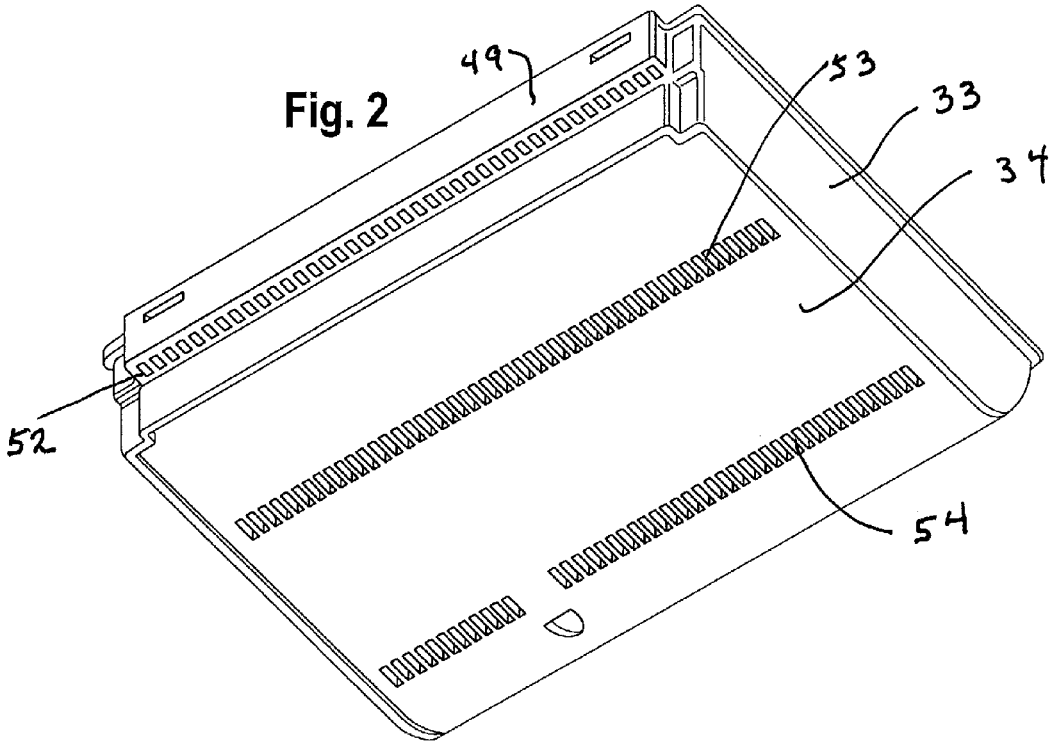
FIG. 2 is a bottom perspective view of the till shown in FIG. 1.

Referring to the drawings and with particular reference to FIGS. 1 and 2, the reference numeral 30 designates a generally rectangular body or frame for the cash drawer insert or till which includes a rearwall 31, a pair of sidewalls 32, 33 and a generally flat bottomwall 34 that extends forwardly into a curved portion 34*a*, terminating in a top edge 36. A transverse or crosswall 37 extends between sidewalls 32, 33, dividing the till into a paper currency receiving and the storage area 38 and a coin receiving and storage area 39.

In the illustrated embodiment, the till body is preferably formed by injection molding from ABS (acrylic-butadience-styrene) resin, however, plastic resins such as polypropylene or polyethylene and others known to those skilled in the art can be employed in the production of these tills. As shown, crosswall 37 is integrally formed with the sidewalls 32, 33, however, it will be appreciated, that the crosswall also could be formed separately and affixed to the interior of sidewalls 32, 33 by a suitable bonding technique.

As shown, rearwall 31 includes a plurality of closely spaced-apart, vertically extending parallel ribs 42 which face a plurality of similarly spaced-apart vertical ribs 43 on the surface of crosswall 37 facing the rearwall. Correspondingly, the opposite side of crosswall 37 includes a plurality of closely spaced-apart vertical ribs 44 which face similarly spaced-apart parallel vertical ribs 46 on the interior surface of the curved portion 34*a* of the till. As will be explained in greater detail below, the spaced-apart ribs 42, 43 are aligned to receive the ends of removable partitions in the paper currency receiving and storage area 38 and the vertical ribs 44, 46 are similarly aligned to receive the ends of the ends of removable partitions inserted in the coin receiving and storage area 39.

As best shown in FIGS. 3, 3A, 4, 5, 6 and 7, the back side of rearwall 31 is also provided with a plurality of vertically extending parallel spaced-apart ribs 47 which overlie a shelf 48 that, in turn, upwardly extends into a wall 49 to define a bill weight attachment channel of 51. Shelf 48 includes a plurality of slots 52 best shown in FIG. 2, which are positioned and sized to receive locking tabs of a bill weight mounting bracket as will be described in greater detail below.

In the embodiments illustrated in FIGS. 1-10, the paper currency receiving and storage area 38 is provided with a series of slots 53 that extend between side panels 32 and 33 which are in alignment with the ribs 42 on rearwall 31 and the ribs of 43 on a crosswall 37 to enable one or more divider panels (described more fully below) to be positioned and securely retained at any desired location within the paper currency storage and receiving section of the till. Correspondingly, a series of slots 54 are provided in the coin receiving area which are sized to receive locking tabs (described more fully hereafter) on partitions which are positioned in the coin receiving and storage area enabling the secure retention of partitions that permit subdividing the coin receiving and storage area in a variety of different configurations as desired. Additional slots 55 in the curved portion 34*a* of bottomwall 34 are also provided for facilitating the secure fixing of coined tray panels as will be discussed more fully below.

Figure 3:
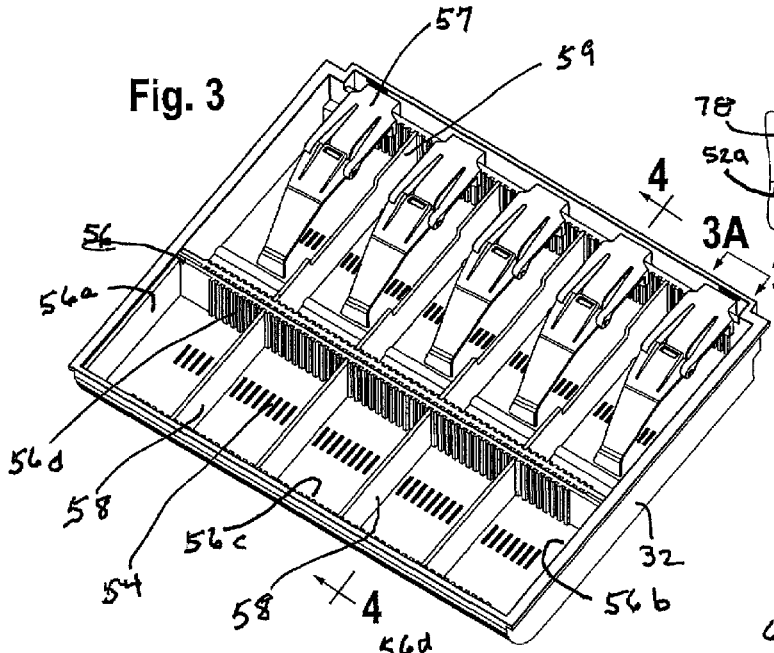
FIG. 3 is a top plan view of the till of FIG. 1 with inserted partitions, bill weights and a removable coin tray.
Figure 4A:
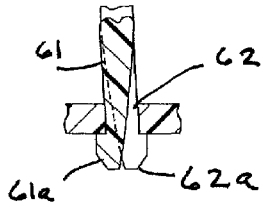
FIG. 4A is a fragmentary sectional view taken along the line 4A-4A of FIG. 4.
Figure 4:
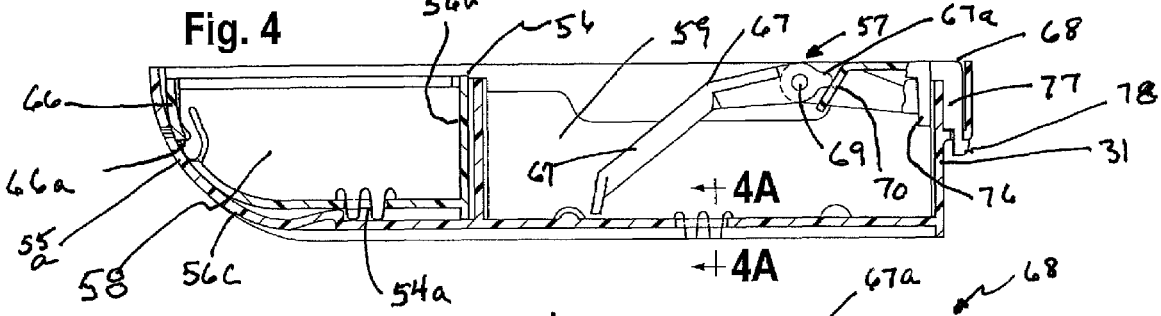
FIG. 4 is a sectional view taken along the line 4-4 of FIG. 3.
Figure 5:
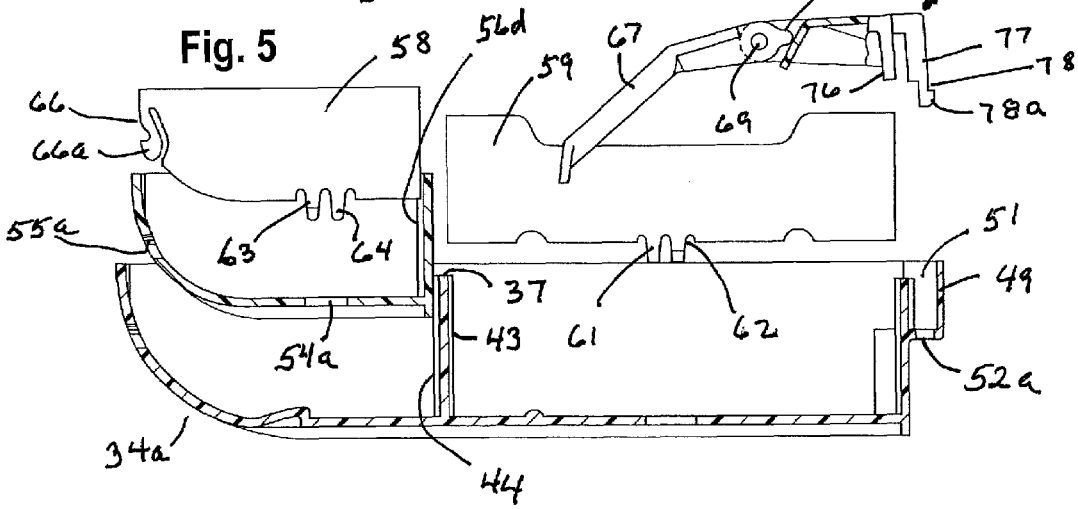
FIG. 5 is an exploded view, partially in section, of the till shown in FIG. 4.

Referring to FIGS. 3-5, a till 30 having a typical U.S. configuration (i.e. 5 paper currency compartments and 5 coin compartments) is shown. In particular, this illustrated embodiment utilizes a removable coin tray 56 having sidewalls 56*a*, 56*b*, curved frontwall 56*c* and backwall 56*d*. A series of ribs 56*e* on backwall 56*d* and 56*f* on the back face of curved wall 56*c* are provided for receiving the end portions of dividers 58 which, can be selectively positioned in the tray 56 at any desired location to provide the required number of coin compartments which can be equal or different sizes as desired.

The paper currency receiving and storage is provided with five bill weights 57 which are centered in compartments for containing various dollar denominations. These separate compartments are defined by the sidewalls 33 and 32 and the divider panels 59, which is provided with a pair of locking tabs 61 and 62 which are oppositely biased so that they can be snap fitted into a common slot in the series of slots designated by the reference numeral 53. As shown in FIG. 4*a*, locking tab 61 includes an enlarged head 61*a* and locking tab 62 includes an enlarged head 62*a* which will engage the bottom periphery of the aperture in which they are received to provide the secure retainment of the panel 59 but which can be pressed together to permit withdrawal of the tab 61 for relocation to another slot.

Correspondingly, panels 58 in the removable coin tray 56 include locking tabs 63 and 64 which are likewise biased in opposite directions so that when they are received in and pass through a common aperture 54*a* in the bottom of the coin tray, they will expand and snuggly engage the peripheral portions of slot 54*a* in much the same fashion as is shown in FIG. 4*a* with respect to the locking studs 61 and 62. In this fashion, removable coin tray panels 58 are securely retained in the coin tray. Additional security, however, is obtained by virtue of a downwardly extending and outwardly biased toggle 66 integrally formed with the panel 58 having a hooked end portion 66*a* which is received in the aperture 55*a* in the front wall 56*c* of the tray.

Figure 3A:
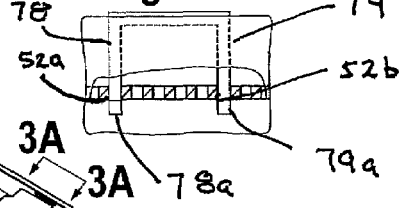
FIG. 3A is a fragmentary elevational view, along the line 3A-3A, partially broken away, showing the mounting bracket for the weight and associated elements for detachably securing the bill weight to the till.

As shown in FIGS. 3, 3A and 4, 5, bill weight 57 includes an arm 67 which is pivotally mounted to a mounting bracket 68 by a pivot pin 69. Arm includes a cam 67*a* that contacts a downwardly inclined resilient finger 70 causing arm 67 to be biased in a downward direction when it is in contact with paper currency in the paper currency compartment in which the bill weight is located. As best shown in FIGS. 3A, 4 and 5, the bill weight is detachably connected to the upper end of rearwall 31 by a mounting bracket 68 which includes an inner support 76 and outer support 77 that tightly fit around the upper edge of rearwall 31. Bracket 77 includes a pair of legs 78 and 79, each of which includes an L-shaped terminal portion 78*a* and 79*a* which secure the mounting bracket in the two slots 52*a* and 52*b* in a fashion which permits selective the removal and relocation of bill weight 57 to any other location along the rearwall as desired.

Figure 6:
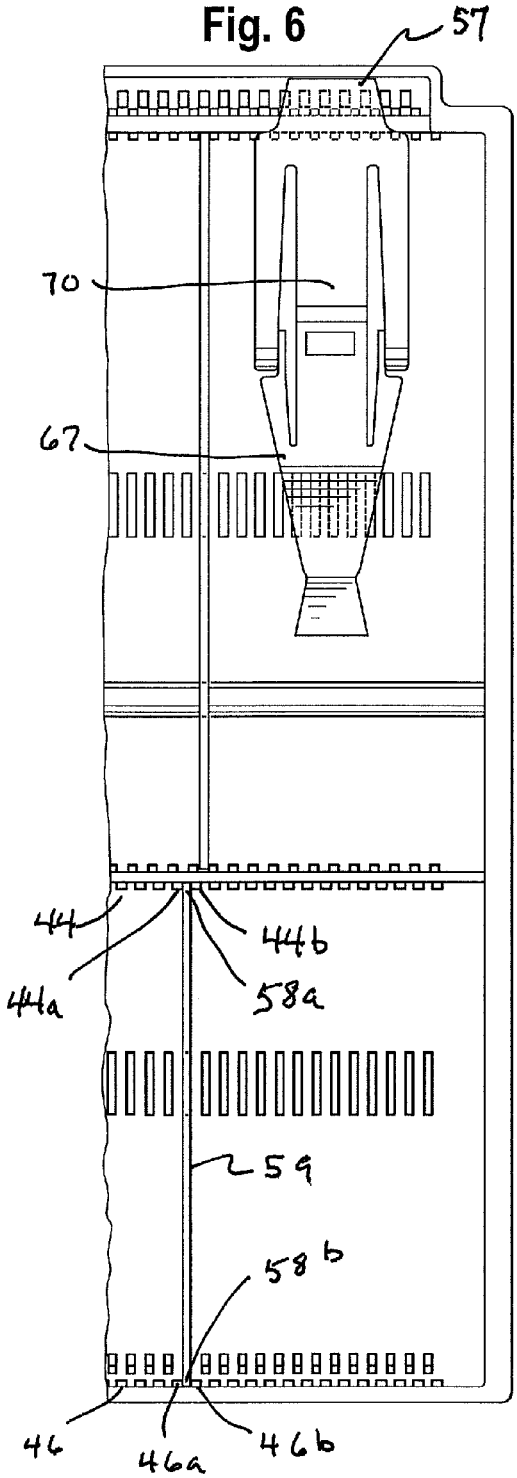
FIG. 6 is a fragmentary top plan view of an alternate embodiment of the till of this invention.
Figure 7:
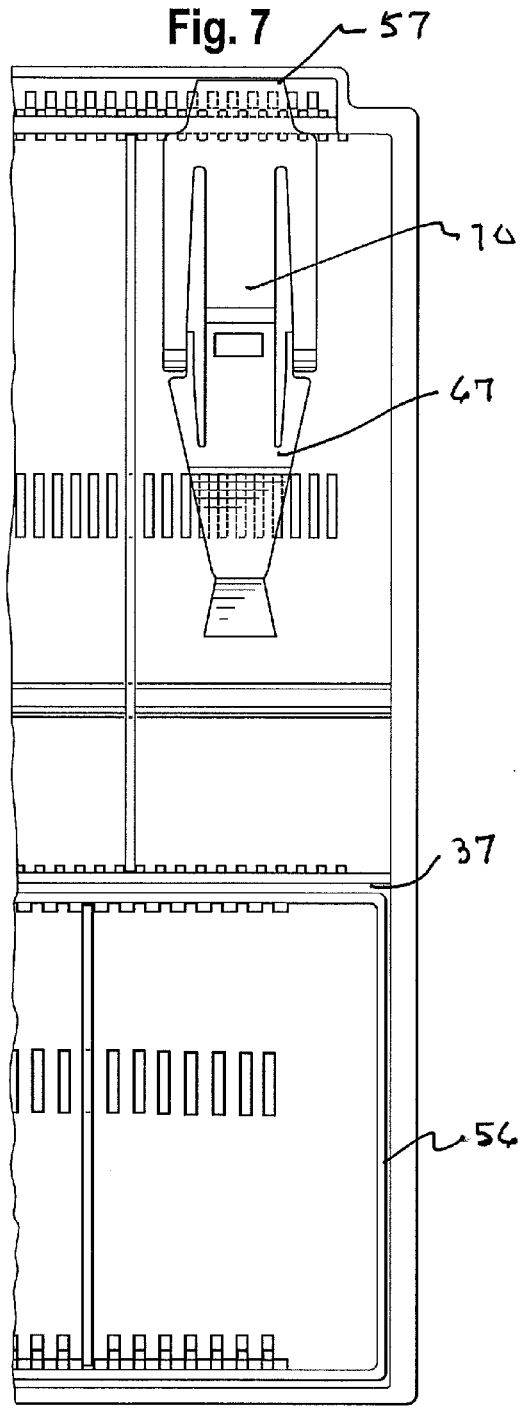
FIG. 7 is a fragmentary top plan view like FIG. 6 of a further embodiment of the till of this invention.

FIGS. 6 and 7 depict alternate embodiments of the present invention. In particular, FIG. 6 illustrates an embodiment wherein the coin receiving area 39 the adjacent crosswall ribs 44*a* and 44*b* receive backedge 58*a* of divider 58 and ribs 46*a* and 46*b* on the curved portion of the bottomwall 34 receive the forward edge 58*b* of divider 58. In all other respects, the embodiment shown in FIG. 6 is similar to that previously described wherein the coin tray is removable. In FIG. 7, the coin tray 56 is removable and corresponds to that previously described in conjunction with FIGS. 3-5. In this embodiment, however, it will be noted that the crosswall 37 includes vertical ribs 43 on the side facing the rearwall 31 while the opposite side of the crosswall does not include any ribs.

Figure 8:
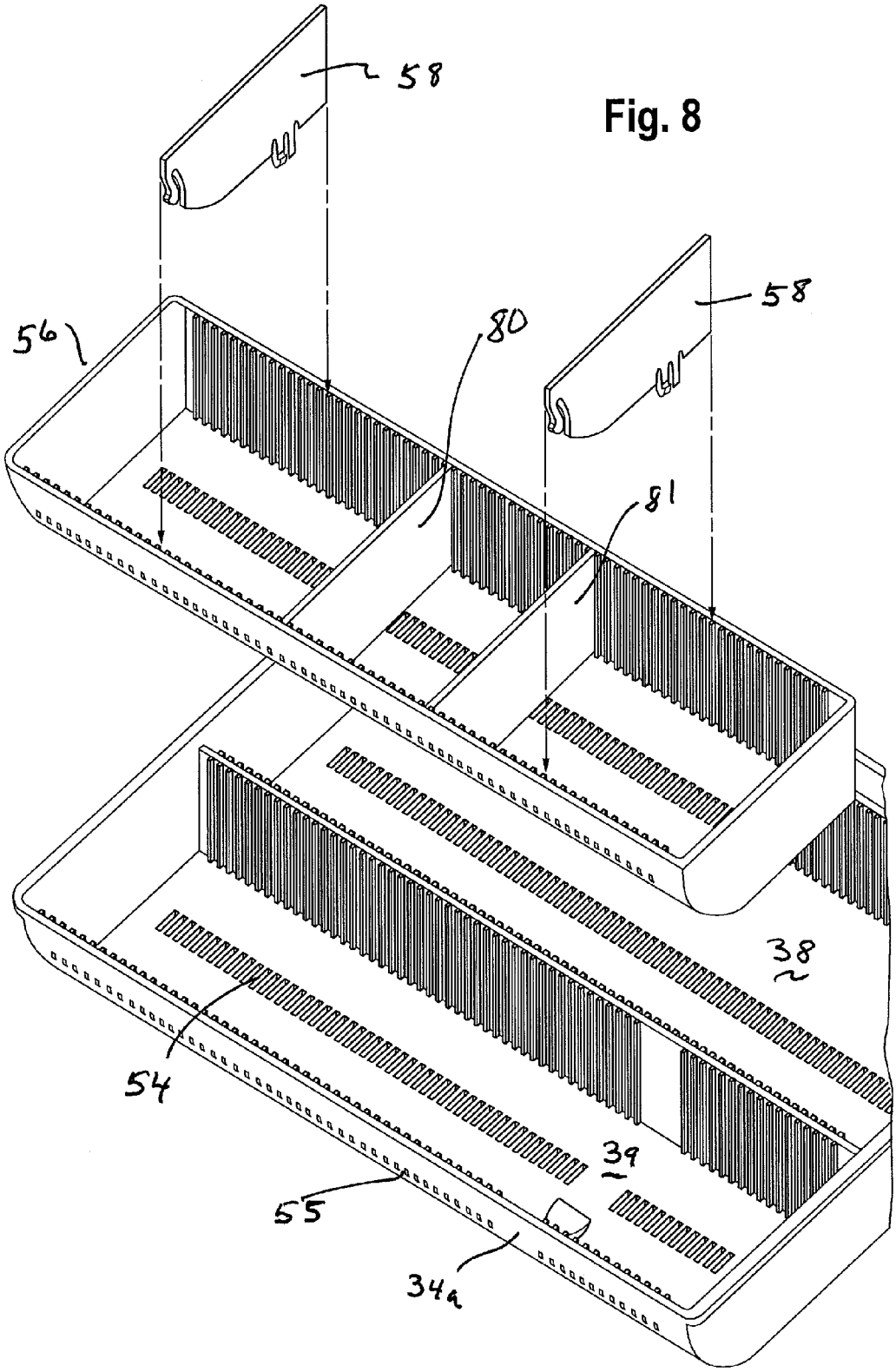
FIG. 8 is an exploded perspective view of a till embodying aspects of the present invention having a modified removable coin tray.

FIG. 8 depicts an embodiment of the present invention wherein the removable tray 56 is shown in association with coin dividers 58 similar to those previously described and two fixed integral dividers 80 and 81 which are either formed during the injection molding of the tray or, alternatively, separately formed and secured to the curved wall and crosswall by a suitable bonding technique.

Figure 9:
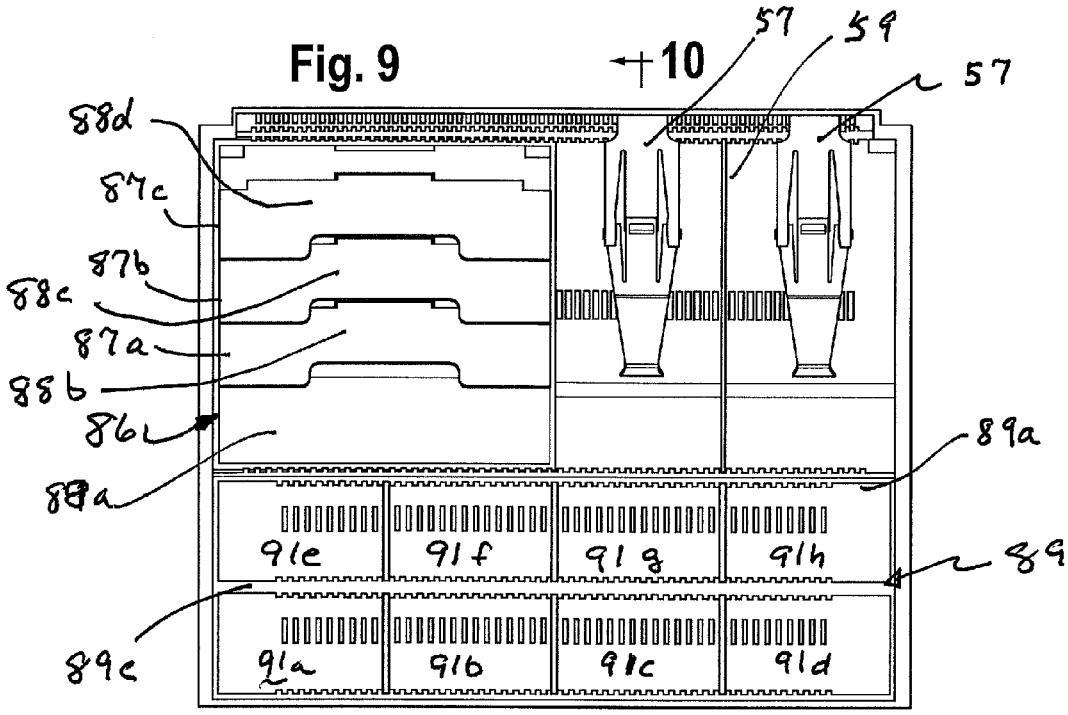
FIG. 9 is a top plan view of another embodiment of a till embodying aspects of the present invention which includes a shelf-type Euro paper currency receiving component in association with two bill weight-equipped paper currency compartments and an eight-compartment coin tray.
Figure 10:
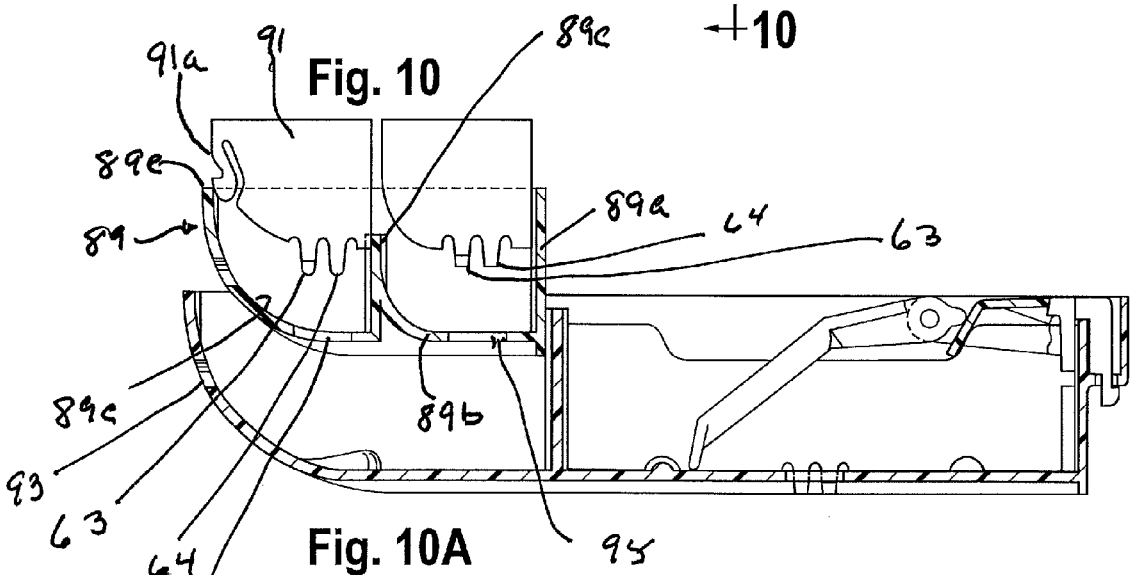
FIG. 10 is an exploded sectional view of the till shown in FIG. 9 taken along the line 10-10.
Figure 10A:
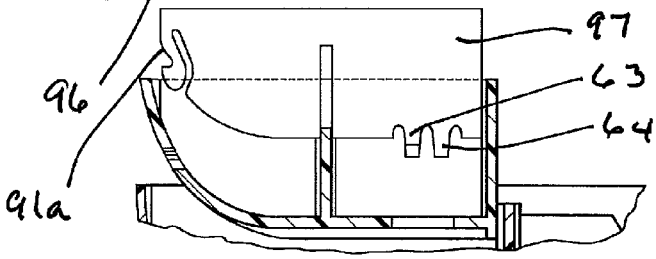
FIG. 10A is a fragmentary sectional view similar to FIG. 10 showing a modified coin tray.
Figure 15:
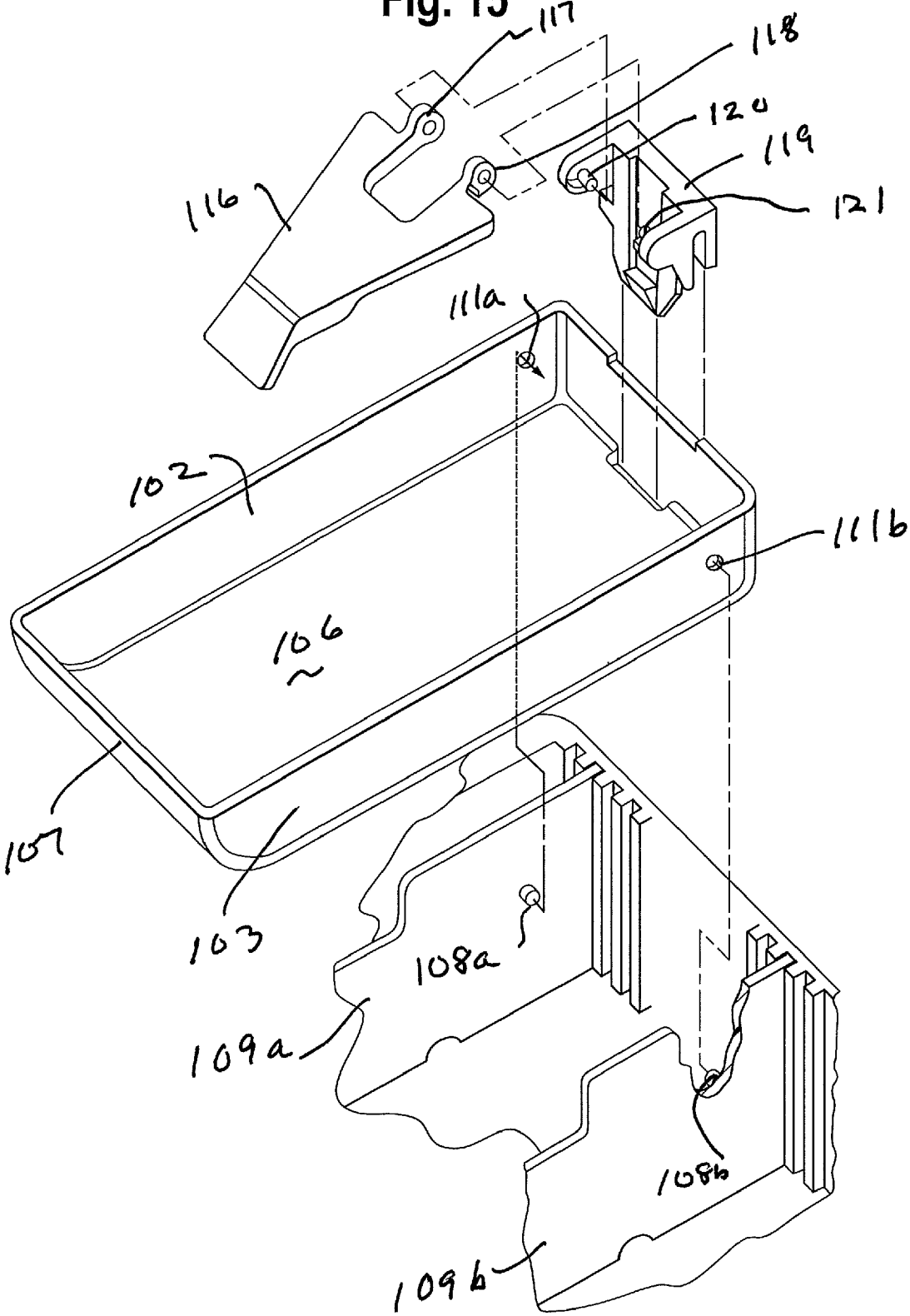
FIG. 15 an exploded fragmentary perspective view of the auxiliary paper currency tray shown in FIGS. 11 and 12.

FIGS. 9-10*a* depict a till construction which is particularly suited for European use. As shown, it includes a Euro style tray 86 with 3 slanted dividers 87*a-c* that provide four aligned slanted note receiving compartments 88*a-d* and two paper currency compartments equipped with bill weights 57 as described above in conjunction with FIGS. 3-5 and a divider partition 59 as previously described.

In accordance with European requirements, a removable coin-receiving tray 89 is provided having eight separate coin receiving compartments 91*a-h*. Removable tray 89 includes a backwall 89*a* having a series of ribs similar to the ribs 56*a* in the tray described in conjunction with FIGS. 3-5. As best shown in FIG. 10, the backwall 89*a* extends forwardly into a first curved bottomwall 89*b* which, in turn, extends into a centerwall 89*c* on both sides of which include vertical extending ribs as best shown in FIG. 9. Centerwall 89*c* extends forwardly into a curved bottomwall 89*d* that terminates in an upper edge 89*e* which is substantially coextensive in height with the sidewalls of the tray. As best shown in FIG. 9, the upper inside surfaces of curved walls 89*c* and 89*d* are each respectively provided with a series of spaced-apart vertical ribs 89*f* and 89*g* which are spaced-apart to receive a divider partitions 91 and 92. As shown, divider panel 91 is similar in configuration to divider panel 58 and includes an outwardly biased locking toggle 91*a* having a hook for locking engagement with a slot 93. In the illustrated embodiment, panel 92 has a forward end which does not include such a locking toggle. In this regard, it will be appreciated that both of the coin divider panels depicted in FIG. 10 can be of the same or different design, e.g. a panel like 91 could be used in the back coin compartment (with provision for an appropriate slot in the wall 89*c* or, alternatively, the panel 92 could be used in place of the panel 91 and, as such, would not require slot 93. Each of the panels 91 and 92 is provided with locking tabs similar to those shown and described in conjunction with FIGS. 4 and 5 and, accordingly, such tabs are identified by the same reference numerals 63, 64. These locking tabs are received in the series of slots 94, 96 (FIG. 10). These locking tabs are likewise biased in opposite directions so that when they are received and passed through the common aperture associated therewith in the bottom of the coin tray, they will expand and snuggly engage a peripheral portions of the slot in the same fashion as is shown in FIG. 4*a*. If desired, an alternative dual divider 97 as shown in FIG. 10A can be provided.

FIGS. 11-15 depict one embodiment of the auxiliary paper currency tray feature of the present invention. As shown, auxiliary tray 101 includes opposed sidewalls 102, 103, a backwall 104 and a bottomwall 106 that extends forwardly into an integral curved portion at the front thereof having an edge 107 coextensive in height with the top edges of the other walls. Auxiliary tray 101 is supported by a pair of pivot pins 108*a* and 108*b* formed in divider panels 109*a* and 109*b* that are on opposite sides of the paper currency compartment in which the auxiliary tray is located. Pins 108*a* and 108*b* are received in the holes 111*a* and 111*b* in the auxiliary tray.

As best depicted in FIG. 12, tray 101 is maintained in a horizontal position when it is fully lowered leaving a space below the bottom surface of the auxiliary tray and the upper surface of the bottomwall of the till. As best shown in FIGS. 12 and 12*a*, this horizontal positioning of the tray is accomplished by buttress 113 which is sized and positioned to engage the forward surface of backwall 104.

Auxiliary tray 101 is provided with a bill weight 116 having a pair of apertured arms 117, 118 which connect to a mounting bracket 119. Bracket 119 includes a pair of pivot pins 120, 121 which are received within the apertured arms 117, 118. The bracket 119 also includes a forwardwall 122 and backwall 123 which define a U-shaped slot that is sized to be tightly received on the backwall 104 of the auxiliary tray. As best shown in FIG. 14, bill weight 116 is biased in the downward direction by an inclined section 123 on the face 118*a* of element 118 and a cam 124 associated with pivot pin 121. This arrangement enables the bill weight 116 to freely rotate when it is in an up position and to be downwardly biased when it is in the position shown in FIG. 12.

Figure 16:
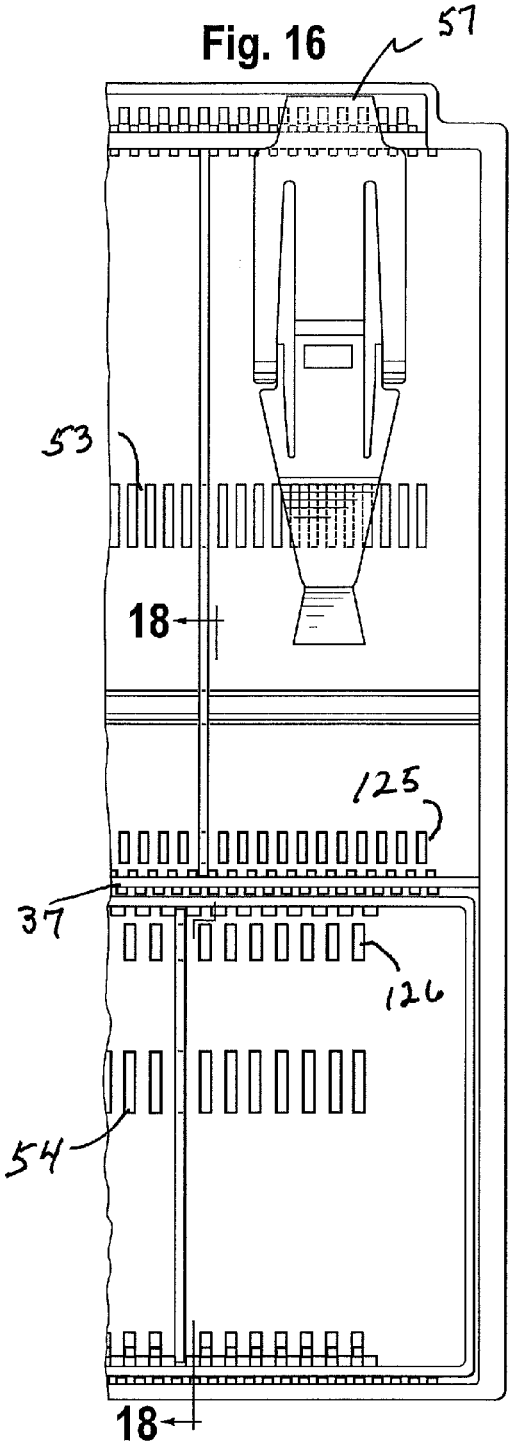
FIG. 16 is a fragmentary top plan view showing a further embodiment of a till featuring aspects of the present invention.
Figure 18:
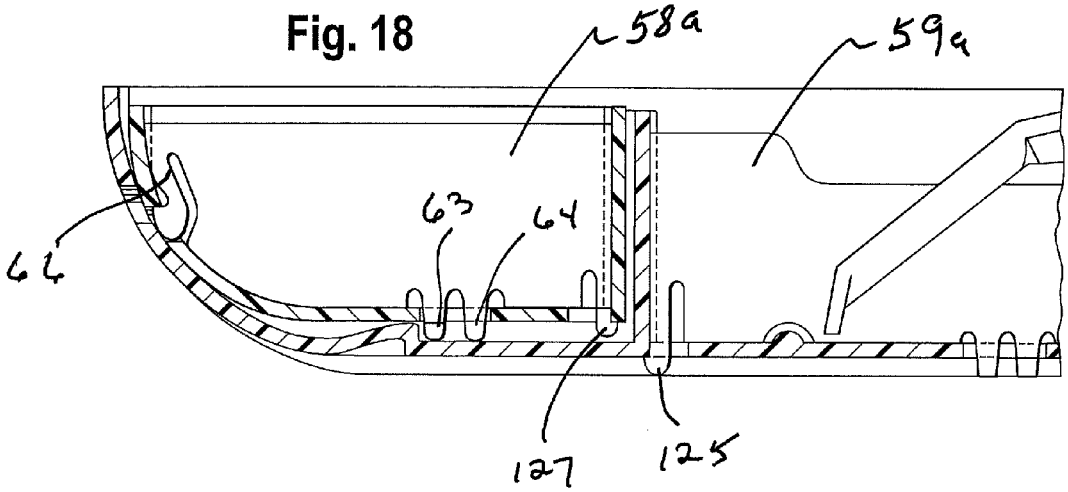
FIG. 18 is a sectional view taken along the line 18-18 of FIG. 16.
Figure 20:
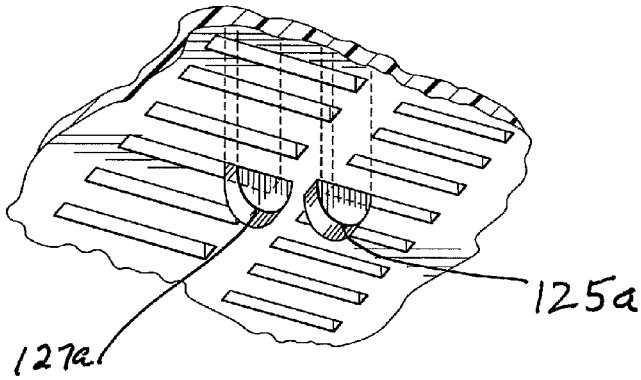

FIGS. 16 and 18 depict an embodiment of the present invention which is provided with additional securement means for the divider panels in the paper currency receiving area and the divider panels in the coin receiving area. As shown in FIG. 16, a series of additional slots 125 are provided at the forward end of the bottomwall of the paper currency receiving area adjacent to centerwall 37 and a similar series of additional slots 126 are provided in the coin tray 56 adjacent backwall 56*d* thereof. The one of the slots 125 cooperates with an additional locking tab 126 in modified panel 59*a* correspondingly an additional locking tab 127 on modified panel 58*a* cooperates with one of the slots 126 in the base of the coin tray. As illustrated by FIG. 20, each of the additional locking tabs 125 and 126 includes a lip which overlaps the peripheral portion of the respective slots 125, 126 to provide a snap fit that affords additional securement for the panels 59*a* and 58*a*. In this regard, it will be appreciated that these additional locking tabs can be used by themselves or in association with the previously described and shown locking tabs 63, 64 and 66.

Figure 17:
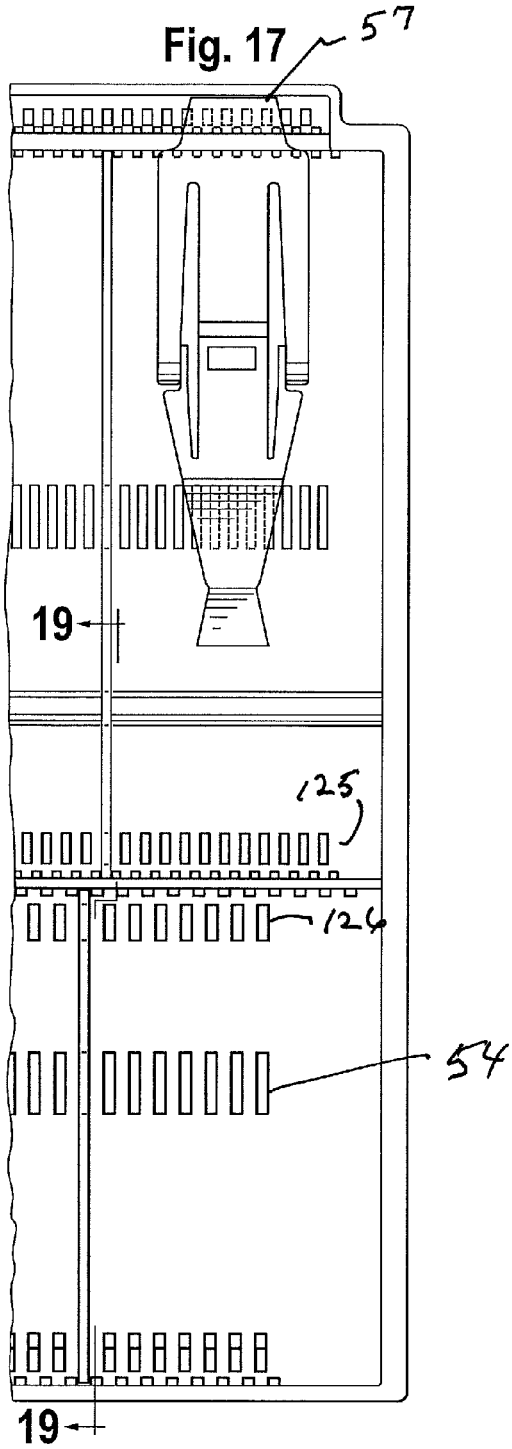
FIG. 17 is a fragmentary top plan view showing a still further embodiment of a till featuring aspects of the present invention.
Figure 19:
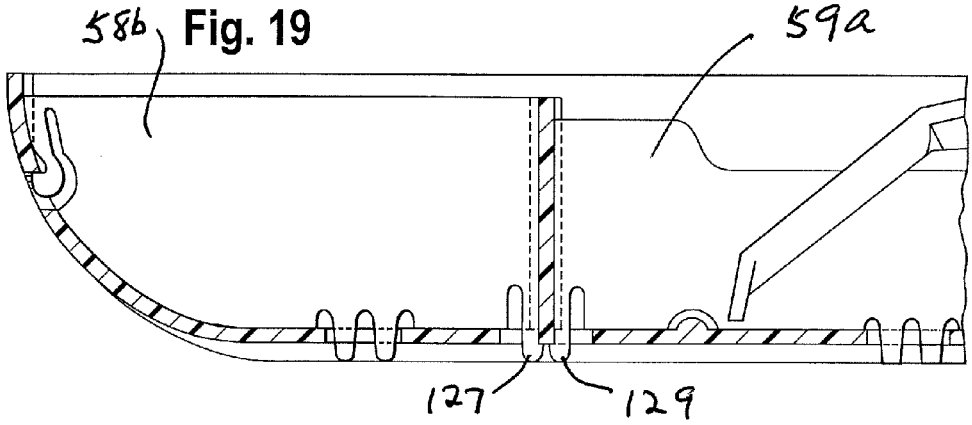
FIG. 19 is a section view taken along the line 19-19 of FIG. 17; and, FIG. 20 is a fragmentary bottom perspective view showing the locking tab at the forward end the divider partition in the paper currency receiving area and the locking tab in the rearward end of the divider partition in the coin receiving area and associated slots as shown in FIG. 19.

Correspondingly, FIGS. 17 and 19 depict the use of these additional locking tabs in embodiments which do not incorporate a separate coin tray. In this embodiment, the paper currency divider panel 59*a* is identical to that previously described. Modified panel 58*b* is directly mounted in a coin receiving area tray. As shown in FIG. 17, the paper currency receiving area incorporates an additional series of slots 125 like those shown and discussed in conjunction with FIG. 16 and the bottomwall of the coin receiving area includes a series of slots 128 similar to the slots 126 in the removable tray shown in FIG. 16. Locking tabs 126 in panel 59*a* and 127 in panel 158*b* are received in these slots 125 and 128 in the same fashion as was previously described in the FIG. 16/18 embodiment.

Although the present invention has been disclosed and described in its preferred and other forms with a certain degree of particularity, it is understood that various modifications and changes may be made to the details thereof without departing from the spirit and scope of this invention as hereinafter claimed.

In the claims

1. A till which can be selectively reconfigured to receive paper currencies and coins of various sizes and denominations, said till comprising:

a generally rectangular body having opposed planar sidewalls, a backwall and a bottomwall having a generally flat surface extending forwardly from said backwall between said sidewalls and terminating in a curved portion having a front edge at a forward end of said body;

a crosswall extending between said sidewalls to define a paper currency receiving and storage area and a separate coin receiving and storage area within said body;

a plurality of spaced-apart vertically extending parallel ribs on the surface of said backwall facing said crosswall;

a plurality of complementary spaced-apart vertically extending parallel ribs on the surface of said crosswall facing said backwall;

a plurality of parallel spaced-apart slots in said paper currency receiving and storage area positioned in complementary relation to the vertically extending ribs on said backwall and crosswall;

at least one paper currency divider partition having end portions sized to be detachably received between opposed adjacent ribs in said backwall and crosswall in generally perpendicular relationship therewith to define a paper currency subsection in said paper currency receiving and storage area selectively sized to accommodate currency of a predetermined size and denomination, said paper currency divider partition having a bottom edge which includes a pair of locking tabs sized to be received in a slot in alignment with the ribs in which the end portions are received, each of said tabs having a locking head biased in a direction opposite to the other tab forming said pair for releasably securing said at least one divider partition in said slot; and a bill weight attachment channel defined in part by the opposite surface of said backwall and a bottom shelf extending rearwardly therefrom, said bottomshelf having a series of channel slots, said opposite surface of said backwall also including a plurality of parallel spaced-apart vertical channel ribs extending rearwardly from the opposite surface of said backwall.

2. The till of claim 1 wherein at least one bill weight is detachably connected to said backwall in operative association with said paper currency subsection, said bill weight including a mounting bracket, said mounting bracket including at least one vertical flange supportingly received between a pair of said adjacent vertical channel ribs, said at least one flange having a locking tab at its distal end received in one of said channel slots.

3. The till of claim 2 wherein said at least one bill weight mounting bracket includes a second vertical flange supportingly received between a second pair of adjacent vertical ribs, said second vertical flange having a locking tab at its distal end received in a second channel slot.

4. The till of claim 1 wherein said tray bottomwall includes a second series of parallel spaced-apart slots adjacent to said crosswall and said at least one divider partition includes an elongated locking toggle at the forward end thereof, said locking toggle having an enlarged head at the tip thereof in detachable engagement with a slot in said second series of parallel spaced-apart slots.

5. The till of claim 1 which includes an auxiliary paper currency tray sized to be received in the currency subsection defined partially by said at least one divider partition, said auxiliary paper currency tray having a bill weight associated therewith, one of said auxiliary paper currency tray and said divider partition including a pivot pin and the other including a hole in alignment therewith for receiving said pivot pin, whereby said auxiliary paper currency tray can be pivoted upwardly when access to the currency subsection is desired and can be returned to its at rest position when access to the currency receiving area of said separate currency tray is desired.

6. The till and auxiliary currency tray of claim 5 wherein a back surface of said auxiliary paper currency tray includes a buttress for maintaining said auxiliary paper currency tray in a parallel orientation to a top surface of said bottomwall in its at rest position.

7. The till of claim 1 wherein said coin receiving and storage area includes a removable coin tray having a rearwall, a pair of sidewalls and a bottomwall which has a flat surface extending forwardly from said rearwall and terminating in a curved portion having a top edge at the forward end thereof, a plurality of spaced-apart vertically extending parallel ribs on the tray rearwall facing the curved portion of the tray bottomwall, a plurality of complementary spaced-apart vertically extending parallel ribs on the curved surface of said tray bottom facing said rearwall, a series of parallel spaced-apart slots in each of said flat and curved portions of said tray bottomwall, said slots being in alignment with the ribs on said rearwall and said curved wall, and at least one coin tray divider partition having end portions detachably received between a pair of adjacent ribs in each of said rear tray wall and said tray curved wall in generally perpendicular relationship therewith to define a coin subsection in said coin tray of a selected size for accommodating coins of a predetermined denomination, said at least one divider partition including a pair of tray partition locking tabs on a bottom edge thereof which are detachably received in a slot in alignment with the coin tray ribs on said rear wall and said curved wall portion, said tray divider partition also including a downwardly extending and outwardly biased locking toggle with an enlarged at the lower end thereof which is snap fitted into a slot in a curved wall portion of said coin tray in alignment with said pairs of adjacent ribs in which the lateral edges of said coin tray divider partition are received.

8. The till of claim 7 wherein said removable coin tray includes an additional series of parallel spaced-apart slots adjacent said rear tray, wall and said at least one divider tray partition includes a downwardly extending elongated locking toggle at the end thereof which is in engagement with said rearwall, said downwardly extending elongated locking toggle having an enlarged head which is detachable engagement with a slot in said additional series of spaced-apart parallel slots.

9. The till of claim 1 which includes at least one currency receiving and storage unit, said unit being received between and in contact with said backwall and said crosswall, said unit including a plurality of aligned slanted partitions which define separate inclined serially aligned currency receiving subsections, each such subsection being suitable for separately containing currencies of different denominations and dimensions.

10. The till of claim 1 wherein the said coin receiving and storage area includes a portion of said flat bottomwall and said curved portion, said crosswall also having a plurality of spaced-apart vertically extending parallel ribs on the opposite side thereof facing said curved portion, a plurality of complementary spaced-apart vertically extending parallel ribs on the surface of said curved portion facing said crosswall, a series of parallel spaced-apart slots in each of said flat and curved portions of the bottomwall within said coin receiving and storage area, said slots being in alignment with the ribs on said opposite side of the crosswall and said curved portion of said bottomwall, at least one coin tray divider partition having edge portions detachably received between a pair of adjacent ribs in each of said opposite side of said crosswall and the curved portion of the bottomwall in generally perpendicular relationship therewith to define a coin subsection in said coin receiving and storage area of a selected size to accommodate coins of a predetermined denomination, said at least one divider partition including a pair of locking tabs sized to be received in a slot in alignment with the pairs of adjacent ribs on said opposite side of the crosswall and the curved wall portion of the bottomwall, said tray divider partition also including a downwardly extending and outwardly biased locking toggle with an enlarged head at the lower end thereof which is snap fitted into a slot in a curved portion of said bottomwall in alignment with said pairs of adjacent ribs.

11. The till of claim 10 wherein said paper currency receiving and storage area includes an additional series of parallel spaced-apart slots adjacent said crosswall and said at least one divider paper currency tray partition includes a downwardly extending elongated locking toggle at the forward end thereof, said downwardly extending elongated locking toggle having an enlarged head which is in detachable engagement with a slot in said additional series of spaced-apart parallel slots.

* * * * *